United States Patent [19]

Yanagisawa

[11] 4,141,272

[45] Feb. 27, 1979

[54] TOM-TOM HOLDER

[75] Inventor: Mitsuo Yanagisawa, Yachiyo, Japan

[73] Assignee: Pearl Musical Instrument Co., Tokyo, Japan

[21] Appl. No.: 871,827

[22] Filed: Jan. 24, 1978

[30] Foreign Application Priority Data

Jan. 25, 1977 [JP] Japan ..... 52-7637

[51] Int. Cl.[2] ..... G10D 13/02

[52] U.S. Cl. ..... 84/421; 248/124; 403/92

[58] Field of Search ..... 84/327, 387 A, 385 B, 84/421, 453; 248/289 R, 291, 124; 403/91, 92, 99, 101

[56] References Cited

U.S. PATENT DOCUMENTS

| | | | |
|---|---|---|---|
| 555,183 | 2/1896 | Rhind | 248/291 X |
| 2,575,540 | 11/1951 | Wenger | 84/387 A X |
| 3,167,292 | 1/1965 | Meyerowitz | 248/124 X |
| 3,535,976 | 10/1970 | Osuga | 84/421 |

*Primary Examiner*—Lawrence R. Franklin
*Attorney, Agent, or Firm*—Bacon & Thomas

[57] ABSTRACT

The hinge joint of a tom-tom holder for maintaining an adjustable angle relationship between a support bar mounted on a bass drum and a tom-tom holding arm adapted to hold a tom-tom comprises a housing connected to the support bar and a bushing connected to the tom-tom holding arm. A resilient band extends along the inner periphery of a cylinder defined in the housing and has one end fixedly secured in the cylinder inner surface and has the other end biased by a band fastening screw threaded in a threaded bore formed in the housing tangential to the cylinder bore. The annular projection of the bushing is received in the cylindrical opening formed by the resilient band. The annular projection and the cylinder bore are maintained in co-axial relationship by an aligning bolt and ring unit. By loosening the band fastening screw, the annular inner face of the disk portion of the bushing and the adjacent end face of the cylinder in the housing are maintained in slidable contact. The tom-tom holding arm can be manually adjusted to a desired angle. Thereafter, by fastening the band fastening screw, the bushing annular projection is fastened about the outer periphery thereof by the resilient band so as to secure the bushing to the housing to maintain the tom-tom holding arm at a desired and adjusted angle with respect to the support bar.

1 Claim, 11 Drawing Figures

TOM-TOM HOLDER

BACKGROUND OF THE INVENTION

This invention relates to a tom-tom holder for holding a tom-tom on a bass drum.

There have been proposed and practically employed a number of tom-tom holders hithertofore and one of the conventional tom-tom holders includes a support bar detachably secured to a bracket on a bass drum and a tom-tom holding arm detachably secured to a bracket on a tom-tom and a hinge was employed to connect the bar and arm together in such a manner that the angular relationship between the bar and arm can be adjusted. As the hinge for this purpose, the so-called ball and socket joint or gear engagement joint was employed. However, the ball and socket joint had the disadvantage that when the angular relationship referred to hereinabove was to be adjusted or varied, each of the balls in the joint had to be loosened by a substantial amount and upon the loosening of the balls, the tom-tom holding arm tended to descend rapidly by the weight of the tom-tom to make it difficult to adjust the angular relationship.

The gear arrangement joint also had the disadvantage that such a unit made it difficult to make adjustment of the angular relationship between the support bar and tom-tom holding arm.

SUMMARY OF THE INVENTION

Therefore, the purpose of the present invention is to provide a tom-tom holder having a joint which permits a precise adjustment of the angular position of the tom-tom holding arm with respect to the support arm and positively maintain the adjusted angular position of the tom-tom holding arm.

According to the present invention, the purpose has been attained by a tom-tom holder which comprises a support bar secured to a bracket on a bass drum, a tom-tom holding arm secured to a bracket on a tom-tom and a hinge joint connecting the support bar and holding arm in an adjustable angle relationship, said hinge joint comprising a cylindrical housing having a socket on the outer surface thereof for receiving said support bar, a bushing having a socket on the outer surface thereof for receiving said tom-tom holding arm and an annular projection on the bushing for insertion into a cylinder bore defined in said cylindrical housing in a peripherally spaced relationship to said cylinder bore, an aligning and self-locking bolt and a ring unit for pivotably supporting said bushing within said housing, a resilient band interposed between said cylinder bore and bushing and having one end secured in said cylinder bore and a band fastening screw for biasing the other end of said band against the outer surface of said annular projection of the bushing, said screw being threaded in a threaded bore communicating between said cylinder bore and the outer surface of the housing.

The above object, other objects, features and advantages of the present invention will be more readily apparent to those skilled in the art from a reading of the following detailed description in conjunction with the accompanying drawings which show one preferred embodiment of the invention for illustration purposes only, but not for limiting the scope of the same in any way.

DETAILED DESCRIPTION OF THE PREFERRED EMBODIMENT

Figure 1:
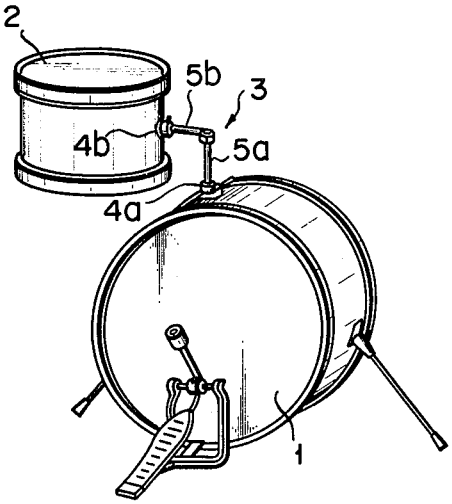
FIG. 1 is a perspective of one preferred embodiment of tom-tom holder according to the present invention showing said holder as being employed for holding a tom-tom on a bass drum.
Figure 2:
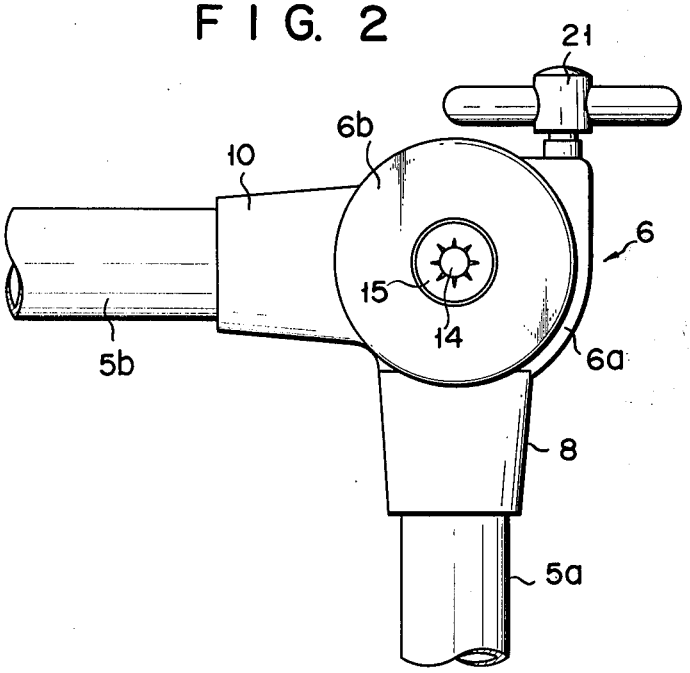
FIG. 2 is a front elevational view on an enlarged scale of said tom-tom holder as shown in FIG. 1.

Referring to FIGS. 1 and 2, a support bar 5*a* is supported on a bass drum 1 by means of a bracket and extends vertically from the bass drum 1 and has the upper end received and fixedly secured in a socket 8 provided on and extending downwardly from the cylindrical housing 6*a* of a hinge joint for the tom-tom holder of the present invention generally shown by reference numeral 3. The bushing 6*b* of the hinge joint is provided with a socket 10 in which a tom-tom holding arm 5*b* is received and fixedly secured and the holding arm maintains a tom-tom 2 at a desired angle with respect to the support arm 5*a*.

The hinge joint includes the cylindrical housing 6*a*, bushing 6*b*, a resilient band 16, a centering set bolt 14 for the housing 6*a* and bushing 6*b* and a locking ring 15 for the set bolt 14.

Figure 6:
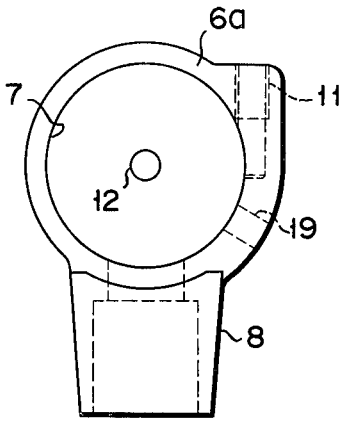
FIG. 6 is a fragmentary front elevational view of the cylindrical housing of the hinge for said tom-tom holder as shown in FIG. 2.
Figure 7:
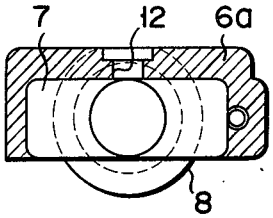
FIG. 7 is a top plan view of said cylindrical housing as shown in FIG. 6.

As more clearly shown in FIGS. 6 and 7, the cylindrical housing 6*a* has a cylinder bore 7 defined therein, the socket 8 which extends downwardly from the housing 6*a* for receiving and fixedly securing therein the support bar 5*a* which extends upwardly of the bass drum 1 in a direction normal to the axis of the cylinder bore 7 and a threaded bore 11 which extends through a projection in a position on the peripheral wall of the cylindrical housing 6*a* in a direction tangential to the cylinder bore 7 to communicate between the outer surface of the housing 6*a* and the interior of the cylinder bore 7. A plain bore is provided right below the threaded bore 11 in communication therewith for the purpose to be described hereinafter. Provided in the above-mentioned projection on the peripheral wall of the cylindrical housing 6*a* in a position below the threaded bore 11 is a radial threaded bore 19 for threadably receiving a set screw 20. The cylinder bore 7 is provided in the center of the bottom thereof with a stepped bore which includes a threaded bore portion 12 and an axially aligned enlarged diameter bore portion for receiving the shank and head of the centering or aligning bolt 14, respectively.

Figure 8:
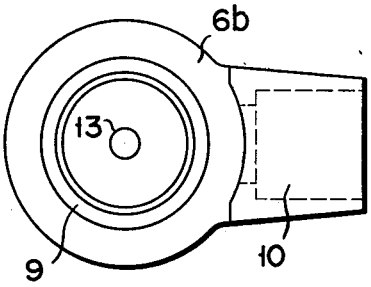
FIG. 8 is a fragmentary rear elevational view of the bushing having an annular projection of the hinge for said tom-tom holder as shown in FIG. 2.
Figure 9:
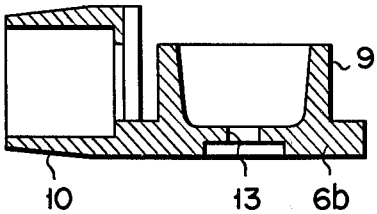
FIG. 9 is a cross-sectional view of said bushing as shown in FIG. 8.

As more clearly shown in FIGS. 8 and 9, the bushing 6b has an annular projection 9 extending laterally and inwardly of the disk portion of the bushing towards the cylindrical housing 6a by a distance slightly smaller than the depth of the cylinder bore 7 in the housing 6a and has an outer diameter slightly smaller than the diameter of the cylinder bore 7 in the housing 6a minus a value twice the thickness of the resilient band 16. The outer diameter of the disk portion of the bushing 6b corresponds to that of the cylinder in the housing 6a. The disk portion of the bushing 6b is provided in the center thereof with a stepped bore which includes a bore portion 13 for receiving the centering bolt 14 which extends in the axial direction of the annular projection 9 and an enlarged diameter bore portion for receiving the locking ring 15, respectively.

Figure 3:
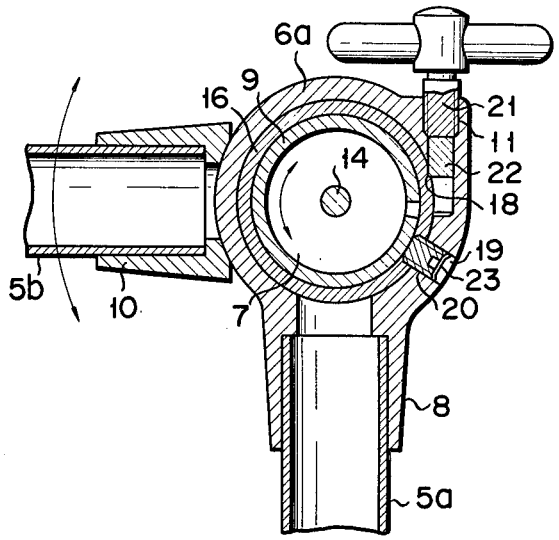
FIG. 3 is a front elevational view in cross-section of said tom-tom holder as shown in FIG. 2.

The centering or aligning bolt 14 has the head at one end and the bar-shaped portion or shank at the other end and is so designed that when the bushing 6b is desired to be assembled to the housing 6a, the shank of the bolt 14 is passed through the aligned bores 12 and 13 formed in the housing 6a and bushing 6b, respectively and the locking ring 15 is then fitted onto the bolt shank whereby the housing 6a and bushing 6b are maintained in axially aligned and assembled relationship and the inner surface of a flanged portion of the bushing 6b slidably engages the adjacent end face of the peripheral wall of the housing cylinder so that the bushing 6b can be rotated about the centering bolt 14 within and relative to the housing 6a as shown by the arrow in FIG. 3.

Figure 10:
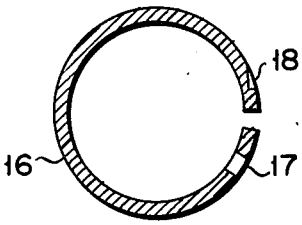
FIG. 10 is a cross-sectional view of the resilient band of the hinge for said tom-tom holder as shown in FIG. 2.
Figure 11:
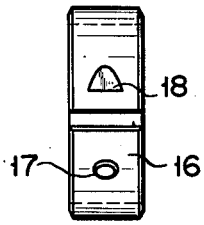
FIG. 11 is a side elevational view of said resilient band as shown in FIG. 10.

As more clearly shown in FIGS. 10 and 11, the resilient band 16 is formed of a substantially circular spring sheet having a portion cut off and has a threaded bore 17 adjacent to one end and a sloped notch 18 formed in the outer surface thereof adjacent to the other end. By further threading the set screw 20 which has been received in the threaded bore 19 in the peripheral wall of the cylinder in the housing 6a into the threaded bore 17 in the resilient band 16, the one end of the band where the threaded bore 17 is provided is fixedly secured in the housing 6a. A free pin 22 is loosely received into the plain bore below the threaded bore 11 in the housing 6a and a band fastening screw 21 is threaded into the threaded bore 11 until the leading or lower end of the screw abuts against the pin 22 whereupon the leading or lower end of the pin 22 is caused to engage the notch 18 in the outer surface of the band. As the fastening screw 21 is threaded into the threaded bore 11 deeper and deeper, the distance between the opposite ends of the resilient band is gradually decreased. It should be understood that the resilient band 16 is placed into the housing 6a and held in position therein under the action of the inherent resiliency of the material of which the band is formed before the housing 6a and bushing 6b are assembled together.

The assembly operation on the tom-tom holder of the invention is performed in the following manner:

(a) The resilient band 16 is placed into the cylinder bore 7 in the housing 6a along the inner periphery of the bore, the set screw 20 is threaded into the threaded bore 19 in the peripheral wall of the housing, the band 16 is moved along the inner periphery of the cylinder bore in the housing until the threaded bore 17 in the band aligns with the housing threaded bore 19. The set screw 20 is then threaded into the now aligned threaded bores 19, 17 and finally, a suitable locking means 23 is fitted into the threaded bore 19 to lock the one end of the resilient band 16 in position.

(b) The other end of the resilient band 16 is guided along the inner periphery of the housing cylinder bore 7 until the notched other end of the band abuts against the adjacent or lower end of the free pin 22 received in the plain bore below the threaded bore 11 in the housing 6a and the band fastening screw 21 is then threaded into the housing threaded bore 11 to impart a light tightening force to the band other end.

Figure 4:
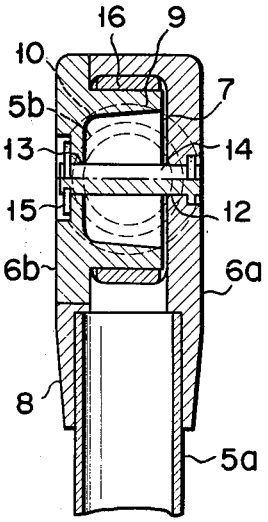
FIG. 4 is a side elevational view in cross-section of said tom-tom holder as shown in FIG. 2.
Figure 5:
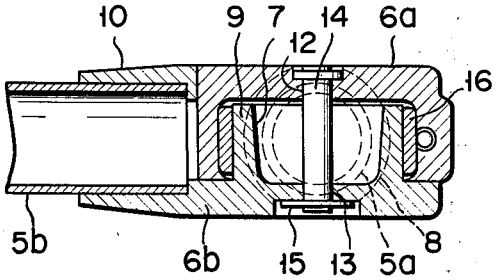
FIG. 5 is a plan view in cross-section of said tom-tom holder as shown in FIG. 2.

(c) The annular projection 9 of the bushing 6b is pressed into the cylindrical opening defined by the resilient band 16 until the disk portion of the bushing 6b comes to contact with the adjacent end face of the housing 6a, the shank of the bolt 14 is inserted into the housing 6a via the bore 12 in the housing until the leading end of the bolt passes into the bore 13 in the bushing 6b and the locking ring 15 is fitted onto the leading end of the bolt 14 from the outer side or lefthand side of the bore 13 as seen in FIG. 4. Thereafter, the ring 15 is applied to the leading end of the bolt 14 in abutment against the ring 15 and tightened in such a manner that the end face of the housing 6a and the adjacent face of the disk portion of the bushing 6b are allowed to slide relative to each other.

(d) The tom-tom holding arm 5b is manually adjusted until the holding arm assumes a desired angle with respect to the support bar 5a and the band fastening screw 21 which has been threaded in the threaded bore 11 in the housing 6b is further tightened until the resilient band 16 tightens the annular projection 9 of the bushing 6b about the outer periphery thereof to thereby prevent relative rotation between the housing 6a and bushing 6b.

The adjustment of the angular position of the tom-tom holding arm with respect to the support bar is performed in the following manner:

(a) The band fastening screw 21 is loosened.

(b) The resilient band 16 is released to expand resiliently by virtue of its inherent resiliency to release its clamping force applied to the annular projection 9 of the bushing 6b.

(c) Even when the band fastening screw 21 has been loosened, the resilient band 16 still retains a certain amount of residual clamping force on the bushing 6b whereby the bushing 6b is effectively prevented from rotating inadvertently by the weight of the tom-tom itself.

(e) After the angular position of the tom-tom holding arm 5b with respect to the support bar 5a has been adjusted to a desired value, the band fastening screw 21 is tightened again to hold the housing and bushing in their assembled position.

In this way, according to the present invention, the angular position of the tom-tom holding arm with respect to the support bar can be easily and precisely adjusted.

While only one embodiment of the invention has been shown and described in detail, it will be understood that the same is for illustration purpose only and not to be taken as a definition of the invention, reference being had for this purpose to the appended claim.

What is claimed is:

1. In a tom-tom holder having a hinge joint connecting between a support bar received and secured in a bracket on a bass drum and a tom-tom holding arm received and secured in a bracket on a tom-tom in such a manner that the angular position of said holding arm with respect to said support bar can be adjusted, characterized by that said hinge joint comprises a cylindrical housing having a cylinder bore therein and a socket on the wall of said cylinder bore for receiving said support bar, a bushing having a disk from the inner side of which an annular projection extends and a socket on the outer side of said disk for receiving said tom-tom holding arm, an aligning bolt and locking ring unit for holding said housing and bushing in co-axial relationship and allowing the bushing to rotate relative to the housing, resilient band interposed between the inner periphery of said cylinder bore and the outer periphery of said annular projection on the bushing and having one end secured in the housing cylinder bore and a band fastening screw threaded in a threaded bore tangential to the housing cylinder bore and communicating between the outer side of said housing and the interior of the cylinder bore, said band fastening screw being adapted to bias the other end of said resilient band.

* * * * *